United States Patent [19]

Harvey

[11] Patent Number: 4,458,363

[45] Date of Patent: Jul. 10, 1984

[54] RAIN COVER FOR CYCLISTS LEGS

[76] Inventor: Marc Harvey, 18, St-Cyrille St., Outremont, Quebec, Canada, H2V 1H8

[21] Appl. No.: 389,946

[22] Filed: Jun. 18, 1982

[30] Foreign Application Priority Data

Jul. 29, 1981 [CA] Canada ..... 382804

[51] Int. Cl.[3] ..... A41D 13/00; A41D 13/06

[52] U.S. Cl. ..... 2/22; 2/82; 2/227; 2/2.1 R; 2/2.1 A

[58] Field of Search ..... 2/2.1 R, 2.1 A, 22, 2/82, 227, 231, 46, 87, 86

[56] References Cited

U.S. PATENT DOCUMENTS 2,239,223 4/1941 Gilman ..... 2/22
2,483,136 11/1938 Hamman et al. ..... 2/36

FOREIGN PATENT DOCUMENTS 685957 6/1938 Fed. Rep. of Germany .
840082 5/1952 Fed. Rep. of Germany .
861509 11/1939 France ..... 2/97
1126925 11/1954 France .

*Primary Examiner*—Werner H. Schroeder
*Assistant Examiner*—Mary A. Ellis
*Attorney, Agent, or Firm*—Robic, Robic & Associates

[57] ABSTRACT

A pair of identical leggings, in one piece, is disclosed and is adapted to cover the front and sides of a cyclist's legs as well as the feet to protect the cyclist from rain, while providing adequate ventilation. The side edges of the leggings are provided with elastic strip material to ensure that the leggings remain on contact with the legs, even when the knees are flexed. Attachment means are provided at the waist and upper rear portion of each leg. Retaining means are provided all along the perimeter of the foot portion of the leggings.

5 Claims, 6 Drawing Figures

RAIN COVER FOR CYCLISTS LEGS

FIELD OF THE INVENTION

The present invention relates to articles of clothing, more specifically to a new type of protective rain gear adapted to protect a cyclist's lower body and legs from getting wet.

BACKGROUND OF THE INVENTION

To ride in the rain, cyclists and motorcyclists frequently have to resort to makeshift apparel in order to prevent themselves from getting wet. For example, motorcyclists are known to resort to waterproof pants which are worn over rubber boots. Such clothing tends to be bulky, heavy and hot. For ordinary cyclists, such clothing is practically out of the question, because of its characteristics, especially lack of ventilation.

Since a cyclist needs protection only against rain and splashings from passing motorists or puddles, essentially airborne water from the front direction, it is not necessary to provide pants which protect all of the legs. Moreover, feet are rarely subject to submersion.

OBJECTS OF THE INVENTION

Accordingly, it is a first object of the present invention to provide a pair of leggings for cyclists which cover only the front and sides of the legs, as well as the top portions of the feet and which is made all in one piece.

It is another object of the present invention to provide rain cover for the legs as described above, which is very lightweight and which adheres closely to the front and sides of the legs, even when the legs are bent at the knee, with minimum number of straps and attachment for rapid and easy installation.

It is yet another object of the present invention to provide rain cover for the legs, which is very inexpensive and which may be conveniently rolled up in a small bundle when not needed.

SUMMARY OF THE INVENTION

The above and other objects and advantages of the present invention are realized according to a preferred embodiment comprising a pair of leggings, each reaching from the waist to the heel and made of lightweight waterproof fabric. These leggings cover only the front and sides of the thighs and the lower legs. At their lower ends, they extend forwardly as an integral foot portion adapted to cover the top and sides of the shoes of the cyclist, leaving only the soles exposed.

To properly secure the leggings to a wearer attachment, means are provided at the waist and also at the upper rear portion of each leg. The vertical side edges of each legging converge at the lower legs to be joined at the heel.

Retaining means are also provided at these vertical side edges, so that the leggings remain in contact with the legs, even when the knees are flexed.

Similar retaining means are also provided all along the perimeter of the foot portion to secure the latter to the sides of the sole of each shoe.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE INVENTION

Figure 6:
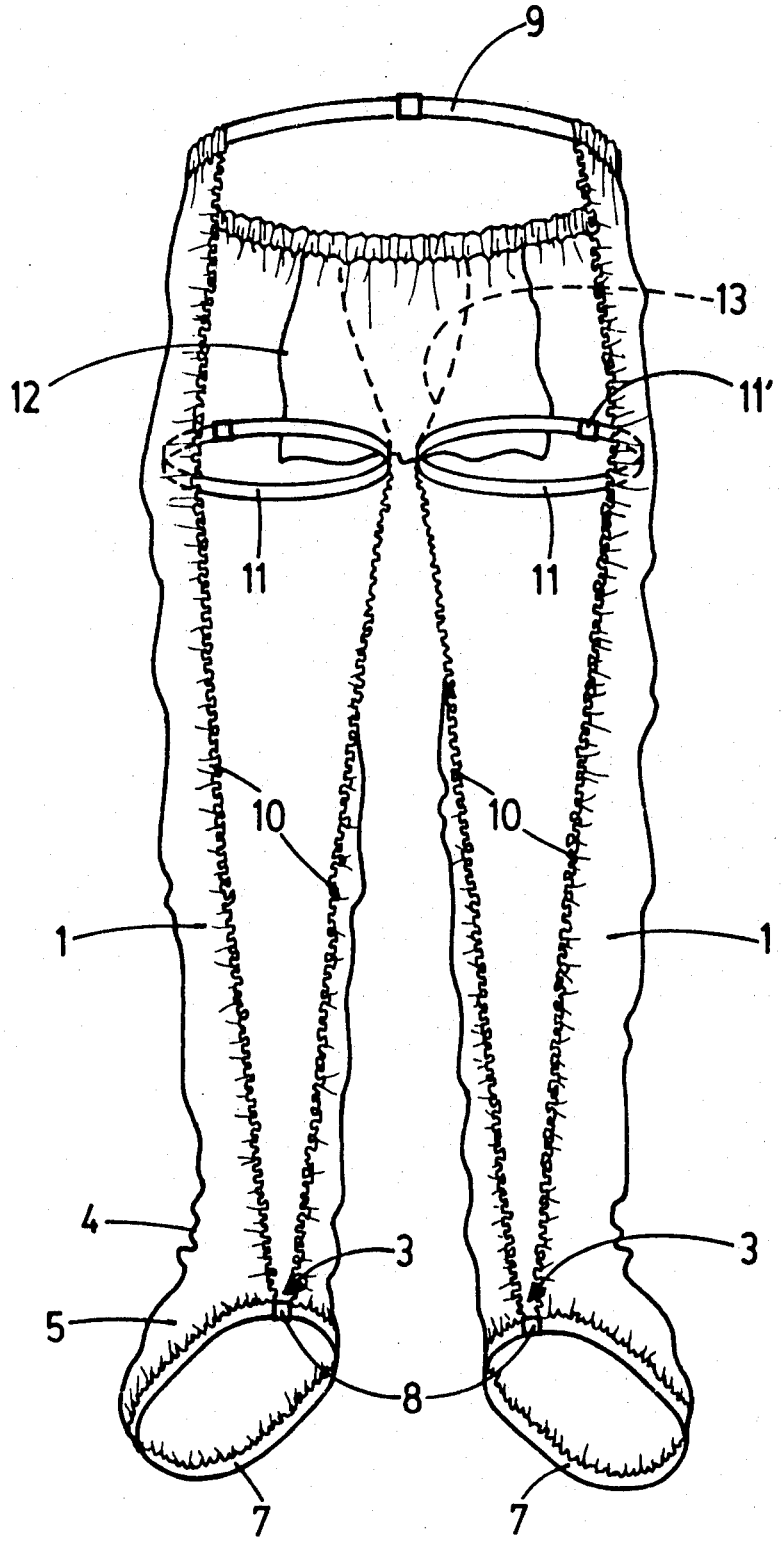
FIG. 6 is another perspective view of the invention, as seen from the rear.

The invention comprises a pair of identical leggings 1 adapted to cover the front and sides of the legs or pants 2 of a wearer and extending from the waist to the heel of each leg and made of light waterproof fabric, such as nylon. As seen clearly in FIG. 6, leggings 1 converge downwardly on each leg and are joined at each heel, as indicated by the numeral 3.

Figure 5:
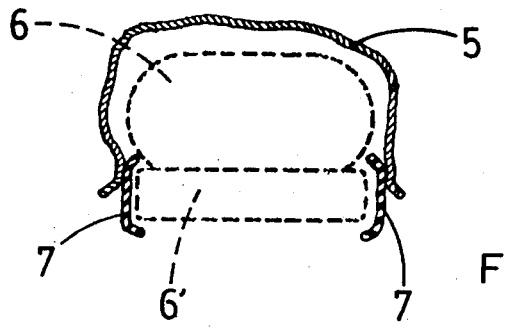

The lower end 4 of each legging 1 extends frontwardly in an integral foot portion 5 adapted to cover each shoe 6 of a cyclist. This foot portion 5 completely covers the shoe 6, as seen in FIG. 5, leaving only the sole 6' exposed. The lower perimeter of each portion 5 is provided with a sewn, or otherwise secured, elastic strip 7 which serves to firmly attach the foot portion 5 to the shoe 6. It is to be noted that the foot portion loosely covers each shoe 6. This construction, along with elastic strip 7, makes it possible for the foot portions 5 to be fitted over different sized shoes.

A clamp 8, located at the heel of each legging 1, detachably attaches the two ends of each elastic strip 7.

The upper ends of each legging 1 are provided with an elasticized belt 9, designed to accommodate the various girths of different wearers around the waist. Belt 9 also allows access to the pants pockets.

Each legging 1 has two vertically-extending side edges. The latter are each provided with a stretchable elastic strip material 10 extending from the waist to the heel. These strips 10 ensure that leggings 1 will closely adhere to the legs, even when the knee is bent.

To further secure leggings 1 to the wearer, straps 11 are provided, each strap 11 extending around the rear of the upper leg portion, and provided with a clamp 11'.

Figure 1:
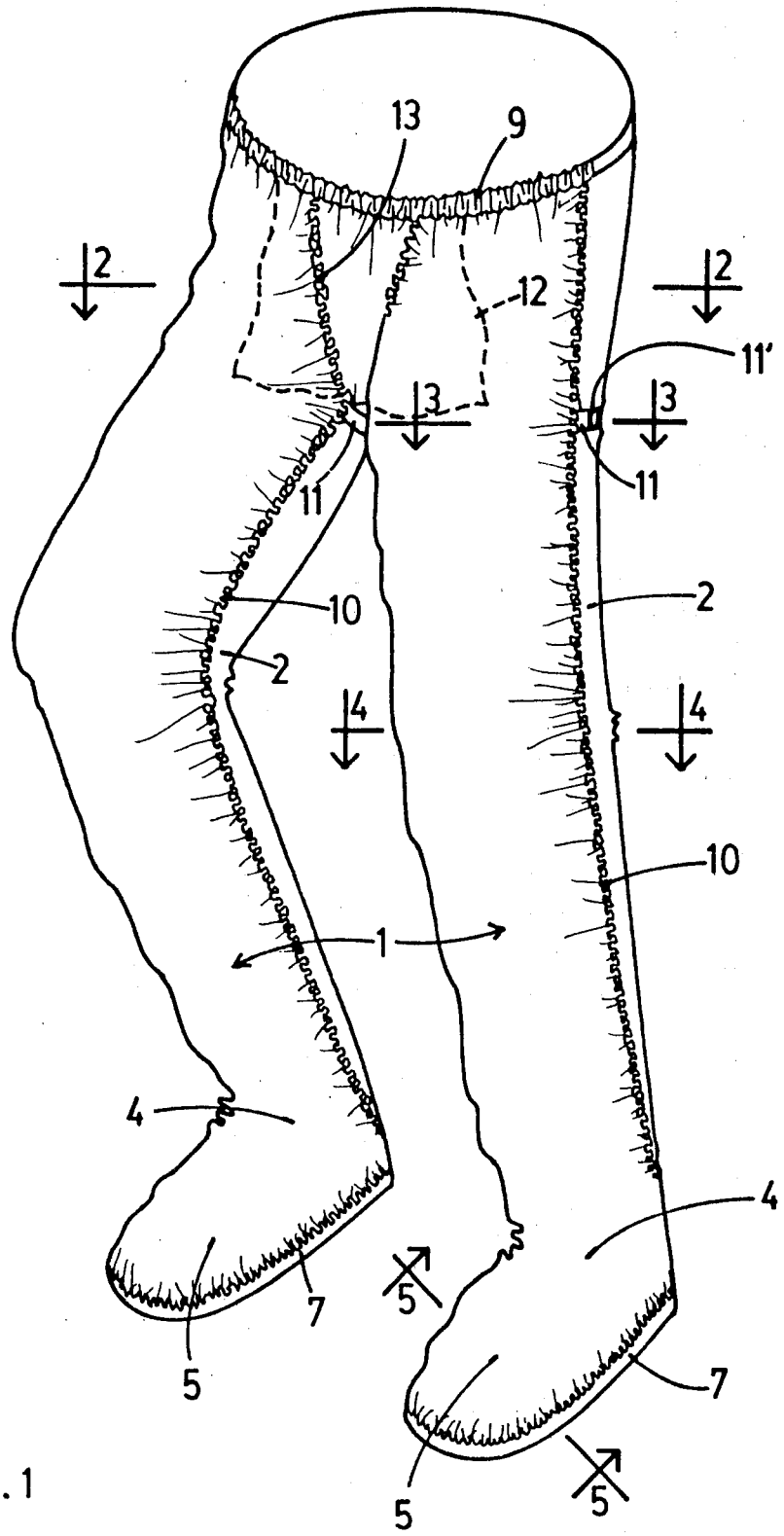
FIG. 1 is a perspective view of the lower body of a wearer, also showing the invention in wearing configuration.
Figure 2:
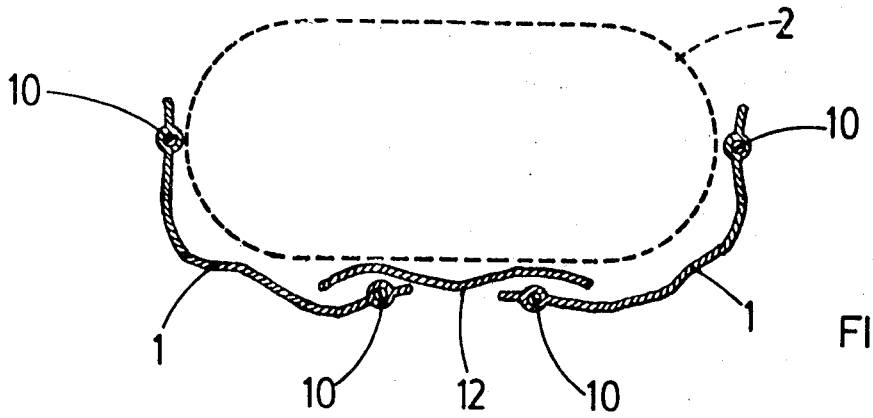
FIGS. 2 to 5 are cross-sectional views taken along lines 2—2, 3—3, 4—4, and 5—5 respectively, of FIG. 1.
Figure 3:
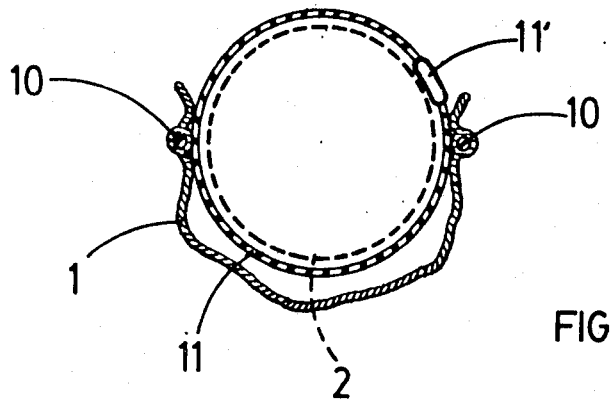
Figure 4:
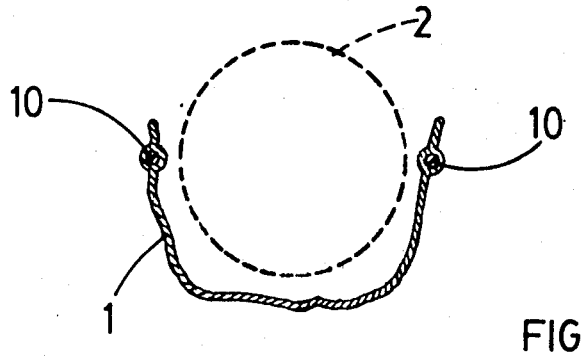

As shown in FIG. 1, the groin area of the invention defines a generally V-shaped opening 13. This is to allow maximum freedom of movement to the wear. To provide maximum protection against rain, the opening is covered by an interior apron 12 having a top edge sewn, or otherwise secured, to belt 9 and being of a generally rectangular shape.

It is to be noted that leggings 1 are made all in one piece and can be conveniently rolled up into a small light bundle when it is not raining or when the streets are dry.

The embodiments of the invention in which an exclusive property or privilege is claimed, are defined as follows:

1. A rain cover for cyclists' legs comprising:

a pair of identical leggings made of waterproof material and reaching from the waist of a wearer to the heel of each leg, said leggings covering only the front and sides of each leg, each said leggings having two vertical side edges;

a foot portion extending forwardly at the lower end of each legging and completely covering each shoe of a wearer, leaving only the sole exposed;

attachment means at the waist to detachably attach said leggings thereto, said attachment means comprising an elasticized belt extending all around said waist;

first retaining means all along said side edges whereby said leggings remain in close contact with each said leg; and second retaining means all along the perimeter of said foot portion to secure the latter to the sole of each said shoe; wherein said first retaining means consists of elastic strip material stretched between said waist and said heel, and said second retaining means is similar elastic strip material having two ends detachably attached by a clasp at said heel.

2. A rain cover for cyclists' legs as defined in claim 1 wherein said side edges of each said legging converge downwardly and meet at each said heel.

3. A rain cover for cyclists' legs as defined in claim 1 wherein a strap is provided around the upper rear part of each leg.

4. A rain cover for cyclists' legs comprising:

a pair of identical leggings made of waterproof material and reaching from the waist of a wearer to the heel of each leg, said leggings covering only the front and sides of each leg, each said leggings having two vertical side edges;

a foot portion extending forwardly at the lower end of each legging and completely covering each shoe of a wearer, leaving only the sole exposed;

attachment means at the waist to detachably attach said leggings thereto, said attachment means comprising an elasticized belt extending all around said waist;

first retaining means all along said side edges whereby said leggings remain in close contact with each said leg; and second retaining means all along the perimeter of said foot portion to secure the latter to the sole of each said shoe; wherein the groin area of the leggings defines an open space, and wherein an apron located interiorly of said leggings and secured to said belt removably covers said open space.

5. A rain cover for cyclists' legs as defined in claim 1 wherein the groin area of the leggings defines an open space, and wherein an apron located interiorly of said leggings and secured to said belt removably covers said open space.

* * * * *